US011554073B1

(12) United States Patent
Guo

(10) Patent No.: US 11,554,073 B1
(45) Date of Patent: Jan. 17, 2023

(54) DOUBLE-HEADED CROSS-RECIPROCATING-SWINGING MASSAGE APPARATUS

(71) Applicant: Xuebin Guo, Hunan (CN)

(72) Inventor: Xuebin Guo, Hunan (CN)

( * ) Notice: Subject to any disclaimer, the term of this patent is extended or adjusted under 35 U.S.C. 154(b) by 0 days.

(21) Appl. No.: 17/892,144

(22) Filed: Aug. 22, 2022

(30) Foreign Application Priority Data

Jul. 21, 2022 (CN) ..... 202210862072.1

(51) Int. Cl.
*A61H 7/00* (2006.01)
*A61H 19/00* (2006.01)
*A61H 23/02* (2006.01)

(52) U.S. Cl.
CPC . *A61H 23/0254* (2013.01); *A61H 2201/0153* (2013.01); *A61H 2201/149* (2013.01); *A61H 2201/1418* (2013.01); *A61H 2201/1669* (2013.01); *A61H 2201/1676* (2013.01)

(58) Field of Classification Search
CPC ..... A61H 23/0254; A61H 2201/149; A61H 2201/1418; A61H 2201/1669; A61H 2201/1676; A61H 19/30; A61H 19/34
See application file for complete search history.

(56) References Cited

U.S. PATENT DOCUMENTS 1,577,751 A * 3/1926 Paschall ..... A61H 7/004 15/22.1
1,612,899 A * 1/1927 Ahlgren ..... A61H 23/0254 601/133
1,931,849 A * 10/1933 Matson ..... A61H 7/005 601/112
5,085,207 A * 2/1992 Fiore ..... A61H 23/0254 601/134
5,183,034 A * 2/1993 Yamasaki ..... A61H 7/005 601/134
5,843,006 A * 12/1998 Phillips ..... A61H 7/005 601/134
6,190,339 B1 * 2/2001 Imazaike ..... A61H 7/005 601/135
2003/0028134 A1 * 2/2003 Lev ..... A61H 23/0263 601/111

(Continued)

OTHER PUBLICATIONS

English translation of WO-2018197317-A1 (Fuster). (Year: 2018).*
English translation of DE-202021104542-U1 (Wang) (Year: 2021).*

*Primary Examiner* — Justine R Yu
*Assistant Examiner* — Christopher E Miller
(74) *Attorney, Agent, or Firm* — Kevin P. Chen

(57) ABSTRACT

The present disclosure discloses a double-headed cross-reciprocating-swinging massage apparatus, which includes a pivoting shaft, a first massage head, a second massage head and a massage driving mechanism. A first end of the first massage head is rotatably connected to the pivoting shaft, and a first end of the second massage head is rotatably connected to the pivoting shaft. The massage driving mechanism is connected to the first end of the first massage head and the first end of the second massage head in a driving way respectively, making the massage driving mechanism be capable of driving the second end of the first massage head and the second end of the second massage head to reciprocally swing about a central axis of the pivoting shaft in a manner of moving towards or away from each other to generate a massage action.

9 Claims, 10 Drawing Sheets

(56) References Cited

U.S. PATENT DOCUMENTS

| | | | | |
|---|---|---|---|---|
| 2003/0158505 | A1* | 8/2003 | Calvert | A61H 7/005 601/134 |
| 2008/0177206 | A1* | 7/2008 | Tung | A61H 23/0254 601/108 |
| 2010/0036298 | A1* | 2/2010 | Fuster | A61H 7/007 601/134 |
| 2014/0121577 | A1* | 5/2014 | Ma | A61H 15/0078 601/112 |
| 2014/0163441 | A1* | 6/2014 | Chen | A61H 7/007 601/111 |
| 2019/0231634 | A1* | 8/2019 | Inada | A61H 23/04 |
| 2022/0096320 | A1* | 3/2022 | Lu | A61H 23/006 |

* cited by examiner

DOUBLE-HEADED CROSS-RECIPROCATING-SWINGING MASSAGE APPARATUS

CROSS-REFERENCE TO RELATED APPLICATIONS

This application claims priority to Chinese Patent Application No. 202210862072.1, filed on Jul. 21, 2022, the entire contents of which are hereby incorporated by reference.

TECHNICAL FIELD

The present disclosure relates to the technical field of massage equipment, and particularly, to a double-headed cross-reciprocating-swinging massage apparatus.

BACKGROUND

Nowadays, a handheld massager in the prior art usually adopts a single massage head or two massage heads which are respectively arranged on two ends of a massage bar and operate independently due to the consideration of design requirements of light operation and compact and simple structure. The related massagers generally rely on vibration to realize the massage effect. Some massagers perform the massage action by swinging of a single head. However, these massage actions are relatively simple, and the massage effect and user experience are not ideal, which cannot meet the user's strong requirement for the massage experience.

SUMMARY

An object of the present disclosure is to provide a double-headed cross-reciprocating-swinging massage apparatus, which has two massage heads and is capable of enabling the two massage heads to generate a massage action in a manner of cross-reciprocating-swinging, so as to enhance the massage effect and improve the massage experience.

In order to achieve the above object, a technical solution of the present disclosure provides a double-headed cross-reciprocating-swinging massage apparatus, including:

a pivoting shaft;

a first massage head including a first end being rotatably connected to the pivoting shaft;

a second massage head including a first end being rotatably connected to the pivoting shaft; and a massage driving mechanism being connected to the first end of the first massage head and the first end of the second massage head in a driving way respectively, making the massage driving mechanism be capable of driving the second end of the first massage head and the second end of the second massage head to reciprocally swing about a central axis of the pivoting shaft in a manner of moving towards or away from each other to generate a massage action.

In some embodiments, the second end of the first massage head is provided with a first flexible massage head, and the second end of the second massage head is provided with a second flexible massage head.

In some embodiments, a first vibration motor is arranged in the first flexible massage head, and a second vibration motor is arranged in the second flexible massage head.

In some embodiments, the massage driving mechanism includes:

a rotary wheel including a first cam joint and a second cam joint, a rotation axis of the rotary wheel being perpendicular to the central axis of the pivoting shaft;

a driving portion being configured for driving the rotary wheel to rotate;

a first converting portion being configured for converting a rotation of the rotary wheel into the reciprocally swinging of the first massage head about the central axis of the pivoting shaft by cooperation of the first converting portion with the first cam joint; and a second converting portion being configured for converting the rotation of the rotary wheel into the reciprocally swinging of the second massage head about the central axis of the pivoting shaft by the cooperation of the second converting portion with the second cam joint, thereby making the second massage head and the first massage head perform the reciprocally swinging massage action in the manner of moving towards or away from each other.

In some embodiments, the first cam joint includes a first boss wheel stacked on the rotary wheel in an eccentric state relative to the rotation axis of the rotary wheel, and a first cam surface is formed on an outer circumferential surface of the first boss wheel;

the second cam joint includes a second boss wheel stacked on the first boss wheel in an eccentric state relative to the rotation axis of the rotary wheel, and a second cam surface is formed on an outer circumferential surface of the second boss wheel;

the first converting portion includes: a first sliding portion defining a first annular hole, the first sliding portion being movably inosculated with the first cam surface of the first boss wheel through the first annular hole; and a first conversion connecting portion connected between the first sliding portion and the first end of the first massage head, for converting a movement of the first sliding portion into the reciprocally swinging of the first massage head about the central axis of the pivoting shaft; and the second converting portion includes: a second sliding portion defining a second annular hole, the second sliding portion being movably inosculated with the second cam surface of the second boss wheel through the second annular hole; a second conversion connecting portion connected between the second sliding portion and the first end of the second massage head, for converting a movement of the second sliding portion into the reciprocally swinging of the second massage head about the central axis of the pivoting shaft; and a guiding structure being configured for guiding the first sliding portion and the second sliding portion to move along a movement path perpendicular to the central axis of the pivoting shaft respectively during rotation of the rotary wheel, moving directions of the first sliding portion and the second sliding portion at the same time being opposite, thereby making the second end of the first massage head and the second end of the second massage head reciprocally swing about the central axis of the pivoting shaft in the manner of moving towards or away from each other.

In some embodiments, the first conversion connecting portion includes: a first shaft rod disposed at a left side of the first sliding portion, a central axis of the first shaft rod extending along a direction parallel to the central axis of the pivoting shaft; and a first engaging slot disposed at the first end of the first massage head, the first engaging slot extending downwards along a longitudinal axis of the first massage head, and the first engaging slot being movably clamped on the first shaft rod; and the second conversion connecting portion includes: a second shaft rod disposed at a right side of the second sliding portion, a central axis of the second shaft rod extending along a direction parallel to the central axis of the pivoting shaft; and a second engaging slot disposed at the first end of the second massage head, the second engaging slot extending downwards along a longitudinal axis of the second massage head, and the second engaging slot being movably clamped on the second shaft rod.

In some embodiments, the guiding structure includes:

a fixed base defining a guiding slot, the guiding slot extending along a direction perpendicular to the central axis of the pivoting shaft;

a first sliding block disposed at an end portion of the first sliding portion, the first sliding block being slidably mounted within the guiding slot for guiding the first sliding portion to move along the movement path perpendicular to the central axis of the pivoting shaft by means of sliding of the first sliding block along the extending direction of the guiding slot; and a second sliding block disposed at an end portion of the second sliding portion, the second sliding block being slidably mounted within the guiding slot for guiding the second sliding portion to move along the movement path perpendicular to the central axis of the pivoting shaft by means of sliding of the second sliding block along the extending direction of the guiding slot.

In some embodiments, the first conversion connecting portion includes: a first swinging end disposed at the first end of the first massage head, the first swinging end extending downwards along the longitudinal axis of the first massage head; and a first link with a first end thereof being pivotally connected with a tail end of the first sliding block through a first articulating shaft and a second end thereof being pivotally connected with the first swinging end through a second articulating shaft, a central axis of the first articulating shaft and a central axis of the second articulating shaft being parallel to the central axis of the pivoting shaft; and the second conversion connecting portion includes: a second swinging end disposed at the first end of the second massage head, the second swinging end extending downwards along the longitudinal axis of the second massage head; and a second link with a first end thereof being pivotally connected with a tail end of the second sliding block through a third articulating shaft and a second end thereof being pivotally connected with the second swinging end through a fourth articulating shaft, a central axis of the third articulating shaft and a central axis of the fourth articulating shaft being parallel to the central axis of the pivoting shaft.

In some embodiments, the first link extends curvedly around and is spaced from an outer circumferential surface of the first sliding portion, the second link extends curvedly around and is spaced from an outer circumferential surface of the second sliding portion, and the first articulating shaft and the third articulating shaft are located at two ends of the first sliding portion, respectively.

In some embodiments, a left side and a right side of the fixed base are provided with a supporting base, respectively, two ends of the pivoting shaft are respectively disposed on the two supporting bases, and the first end of the first massage head and the first end of the second massage head are pivotally connected to the pivoting shaft at intervals along the central axis of the pivoting shaft.

It can be seen from the above technical solutions that the second end of the first massage head and the second end of the second massage head are driven to reciprocally swing about the central axis of the pivoting shaft by the massage driving mechanism in the manner of moving towards or away from each other to generate the massage action, and the first massage head and the second massage head reciprocally swing to massage body parts, thus to achieve two-way swinging massage, accelerate the swinging rate and increase the number of massages, thereby enhancing the massage effect, improving the massage experience, and meets the user's strong requirement for the massage experience.

BRIEF DESCRIPTION OF THE DRAWINGS

In order to illustrate the technical solution in embodiments of the present disclosure more clearly, the following briefly introduces accompanying drawings used in the description of the embodiments. Obviously, the accompanying drawings in the following description are only some embodiments of the present disclosure. Those of ordinary skill in the art can obtain other accompanying drawings from these accompanying drawings without any creative efforts.

Figure 1:
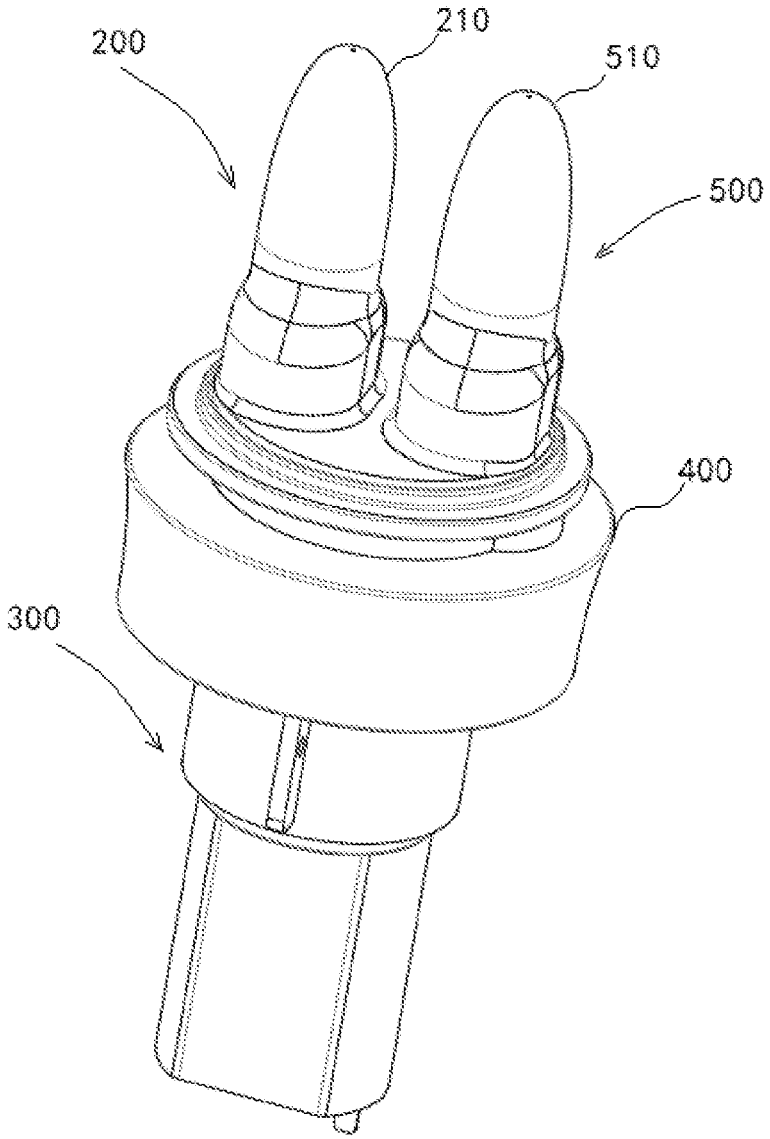
FIG. 1 is a schematic view showing a part of a double-headed cross-reciprocating-swinging massage apparatus according to an embodiment of the present disclosure.
Figure 2:
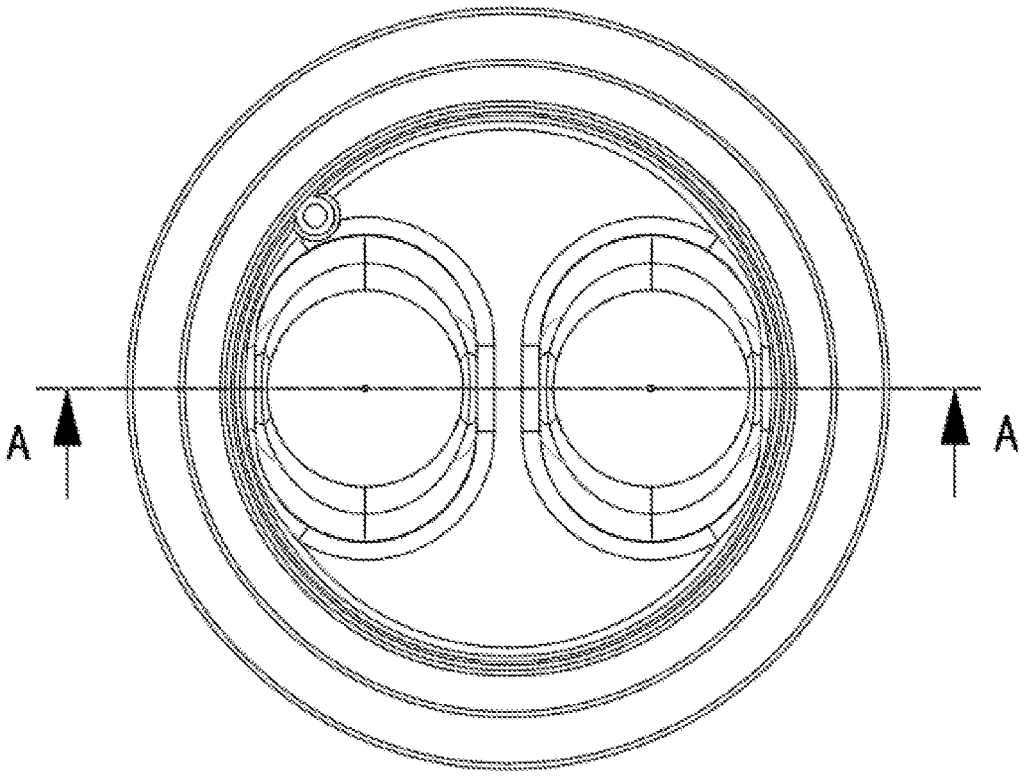
FIG. 2 is a top view of the double-headed cross-reciprocating-swinging massage apparatus according to an embodiment of the present disclosure.

Among them, the above-mentioned accompanying drawings include the following reference signs:

100, pivoting shaft;
200, second massage head;
210, second flexible massage head;
220, second vibration motor;
230, second engaging slot;
240, flexible annular end surface;
250, second swinging end;
300, massage driving mechanism;
310, driving portion;
311, output shaft;
320, rotary wheel;
321, first boss wheel;
322, second boss wheel;
330, second converting portion;
331, second sliding portion;
332, second annular hole;
333, second sliding block;
334, second shaft rod;
335, second flange;

340, first converting portion;
341, first sliding portion;
342, first annular hole;
343, first sliding block;
344, first shaft rod;
345, first flange;
350, guiding structure;
351, fixed base;
3511, small cylindrical sleeve;
3512, large cylindrical sleeve;
3513, guiding slot;
3514, supporting base;
360, second conversion connecting portion;
361, second link;
362, fourth articulating shaft;
363, third articulating shaft;
370, first conversion connecting portion;
371, first link;
372, second articulating shaft;
373, first articulating shaft;
400, front end cover;
410, through hole;
500, first massage head;
510, first flexible massage head;
520, first vibration motor;
530, first engaging slot;
540, cylindrical barrel;
550, first swinging end;
600, outer housing;
610, switch button;
620, left shell;
630, right shell;
700, circuit board; and
800, rechargeable battery.

DESCRIPTION OF THE EMBODIMENTS

Embodiments of the present disclosure provide a double-headed cross-reciprocating-swinging massage apparatus, to solve the technical problem that a massager in the prior art is poor in massage effect and experience and cannot meet the strong requirement of a user for the massage experience due to the adoption of a single-headed massage action. By designing the two massage heads to reciprocally swing to cross-reciprocally massage body parts, the double-headed cross-reciprocating-swinging massage apparatus realizes the two-way swinging massage, and increases the swinging rate and the number of massages, thereby enhancing the massage effect, improving the massage experience, and meeting the strong requirement of the user for the massage experience.

In order to make those skilled in the art better understand the technical solution of the present disclosure, the technical solution in the embodiments of the present disclosure will be clearly and completely described below with reference to accompanying drawings in the embodiments of the present disclosure. Obviously, the described embodiments are only a part of the embodiments of the present disclosure, but not all of the embodiments. Based on the embodiments of the present disclosure, all other embodiments obtained by those skilled in the art without any creative efforts fall within the protection scope of the present disclosure.

Referring to FIG. 1 to FIG. 10, in this embodiment, a double-headed cross-reciprocating-swinging massage apparatus is provided and includes a pivoting shaft 100, a first massage head 500, a second massage head 200 and a massage driving mechanism 300. A first end of the first massage head 500 is rotatably connected to the pivoting shaft 100. A first end of the second massage head 200 is rotatably connected to the pivoting shaft 100. The massage driving mechanism 300 is respectively connected to the first end of the first massage head 500 and the second end of the first massage head 500 in a driving way, such that the massage driving mechanism 300 drives a second end of the first massage head 500 and a second end of the second massage head 200 to reciprocally swing about a central axis of the pivoting shaft 100 in the manner of moving towards or towards or away from each other to generate a massage action.

The double-headed cross-reciprocating-swinging massage apparatus is mainly used in a hand-held massager for massaging some body parts. According to massaging requirements for certain body parts, some massage components can be adaptively fixed on head portions of the first massage head 500 and second massage head 200, or the head portions of the first massage head 500 and the second massage head 200 can be designed into a specific massager-shape.

Figure 6:
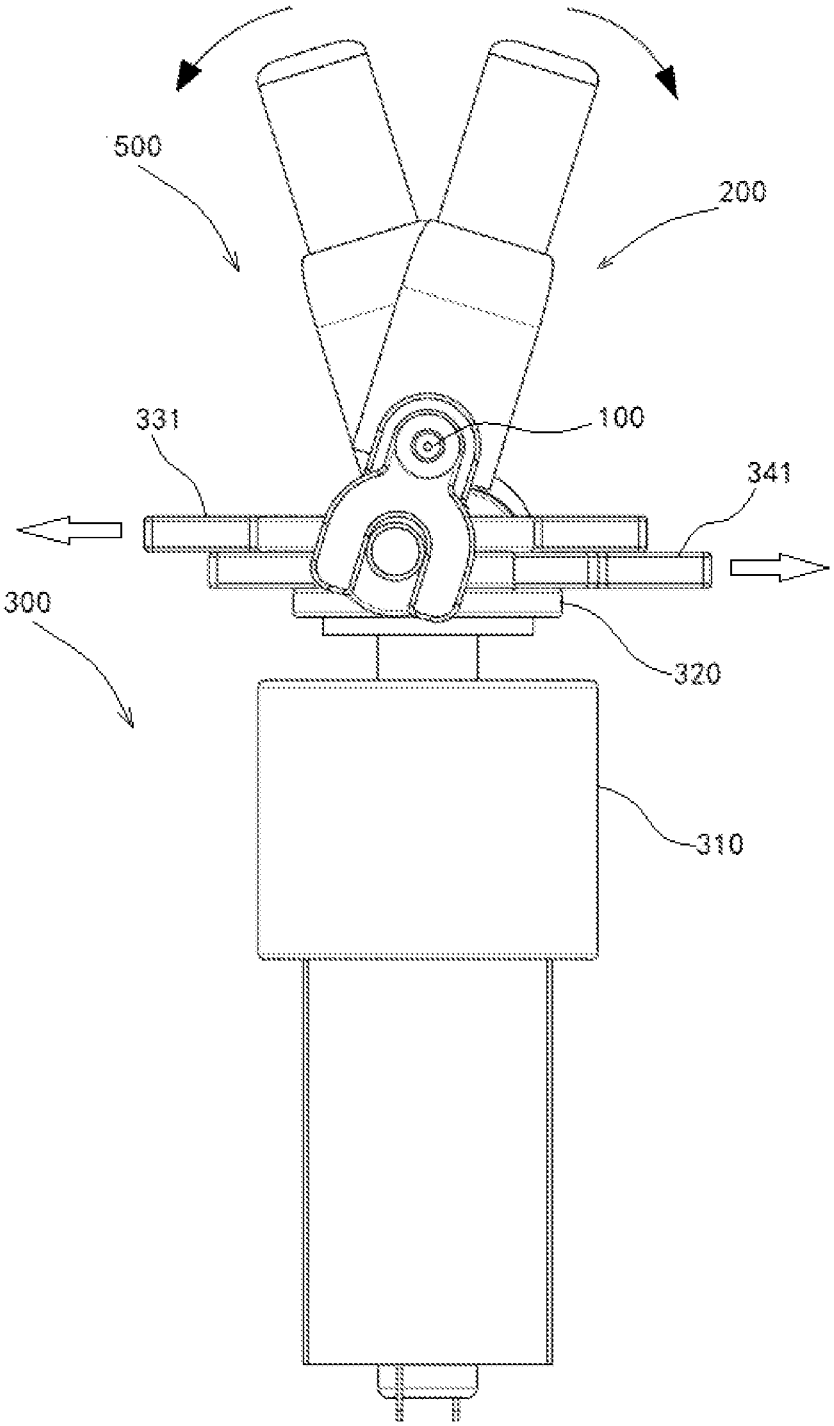
FIG. 6 is a side view of FIG. 5 according to the embodiment of the present disclosure.

It can be seen that, as shown in FIG. 6, for the double-headed cross-reciprocating-swinging massage apparatus of this embodiment, the second end of the first massage head 500 and the second end of the second massage head 200 are driven by the massage driving mechanism 300 to reciprocally swing about the central axis of the pivoting shaft 100 in a manner of moving towards or away from each other to generate a massage action. The first massage head 500 and the second massage head 200 reciprocally swing to massage the body parts, thus to achieve two-way swinging massage, accelerate the swinging rate and increase the number of massages, thereby enhancing the massage effect, improving the massage experience, and meeting the user's strong requirement for the massage experience.

In this embodiment, as shown in FIG. 1 to FIG. 4, the second end of the first massage head 500 is provided with a first flexible massage head 510, and the second end of the second massage head 200 is provided with a second flexible massage head 210. The flexible massage head is more soft and friendly to the body skin, which makes the massaged body parts be more comfortable and the body skin be avoided be abraded. The massage head can be made of silicone or rubber. Massage heads made of other flexible materials can be available. The first massage head 500 and the second massage head 200 are arranged in mirror symmetry, and the shapes and the structures of the first flexible massage head 510 and the second flexible massage head 210 can be adaptively designed according to the body parts needed to be massaged.

Figure 4:
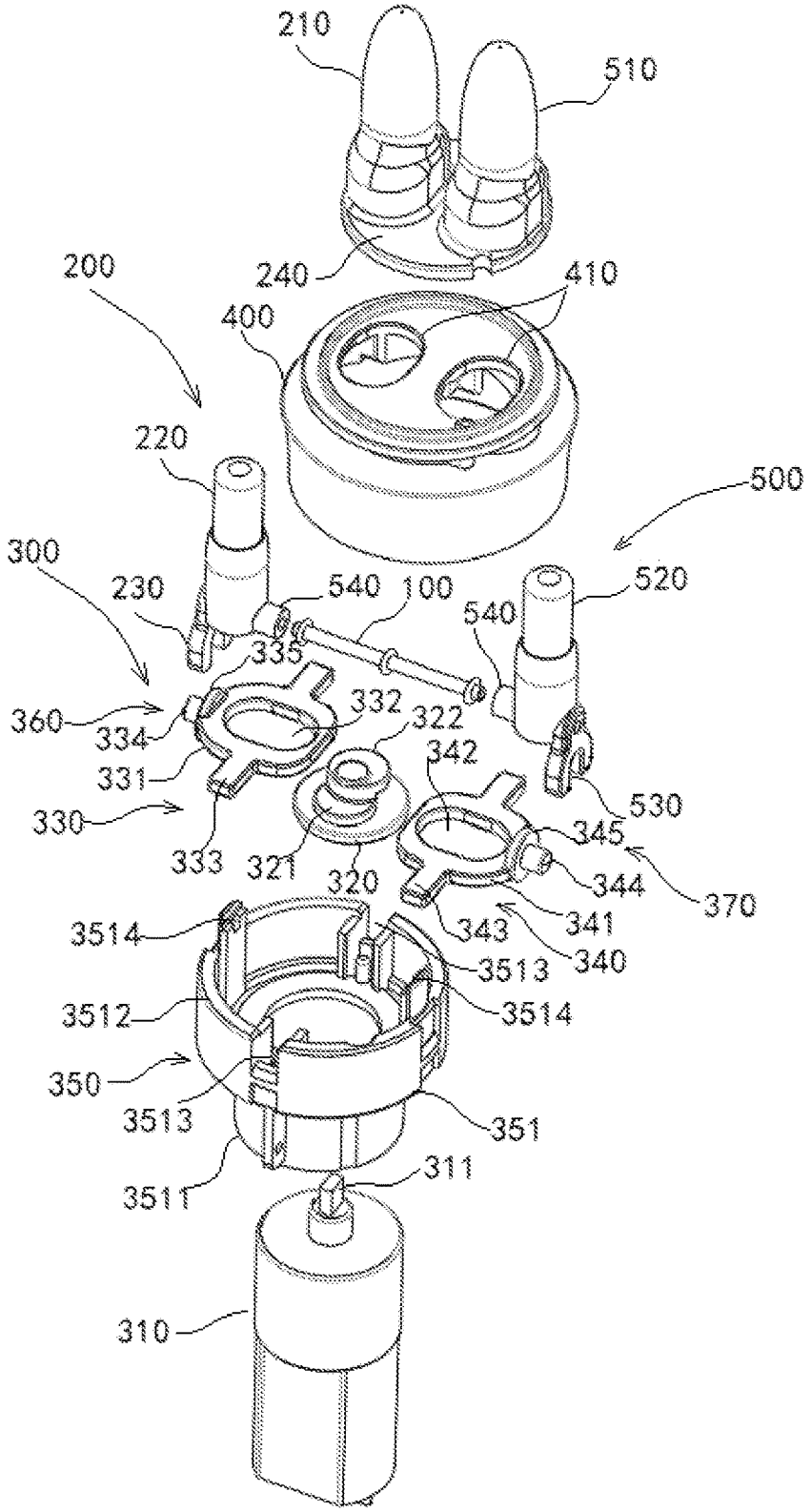
FIG. 4 is an exploded view of the double-headed cross-reciprocating-swinging massage apparatus according to an embodiment of the present disclosure.

As shown in FIG. 1 and FIG. 4, the double-headed cross-reciprocating-swinging massage apparatus of this embodiment includes a front end cover 400. The front end cover 400 is substantially in a shape of a cylinder, and has a pair of through holes 410 defined in a front end surface thereof. The pair of through holes 410 has a waist shape or an oval shape, and extends in a direction perpendicular to the central axis of the pivoting shaft 100 on the front end surface of the front end cover 400. The first massage head 500 and the second massage head 200 are respectively inserted in the pair of through holes 410 in a one-to-one correspondence manner, and a space is reserved for the reciprocally swinging of the first massage head 500 and the second massage head 200 through the through holes 410, such that the first massage head 500 and the second massage head 200 reciprocally swing in an extending direction of the through holes 410 while reciprocally swinging about the central axis of the pivoting shaft 100.

A lower end of the first flexible massage head 510 is connected with a lower end of the second flexible massage head 210 through a flexible annular end face 240 to form an integral structure, and the second end of the first massage head 500 and the second end of the second massage head 200 are inserted into the first flexible massage head 510 and the second flexible massage head 210 in a one-to-one correspondence manner. The flexible annular end surface 240 is fixedly mounted on the front end surface of the front end cover 400, so as to achieve the sealing effect of water-proof and moisture-proof.

Specifically, as shown in FIG. 1 and FIG. 4, a first vibration motor 520 is mounted in the first flexible massage head 510, and a second vibration motor 220 is mounted in the second flexible massage head 210.

Accommodating slots are defined in and extend along the axial directions of the second end of the first massage head 500 and the second end of the second massage head 200, respectively. The accommodating slots are cylindrical-shaped slots. The first vibration motor 520 and the second vibration motor 220 both are cylindrical-shaped. A lower end of the first vibration motor 520 and a lower end of the second vibration motor 220 are respectively accommodated in the accommodating slots of the first massage head 500 and the second massage head 200, and an upper end of the first vibration motor 520 and an upper end of the second vibration motor 220 are respectively accommodated in the first flexible massage head 510 and the second flexible massage head 210 in a one-to-one correspondence manner. The first massage head 500 and the second massage head 200 cross-reciprocally swing to reciprocally massage body parts in combination with vibration massages of the first vibration motor 520 and the second vibration motor 220, the massage effect is more intense.

Figure 9:
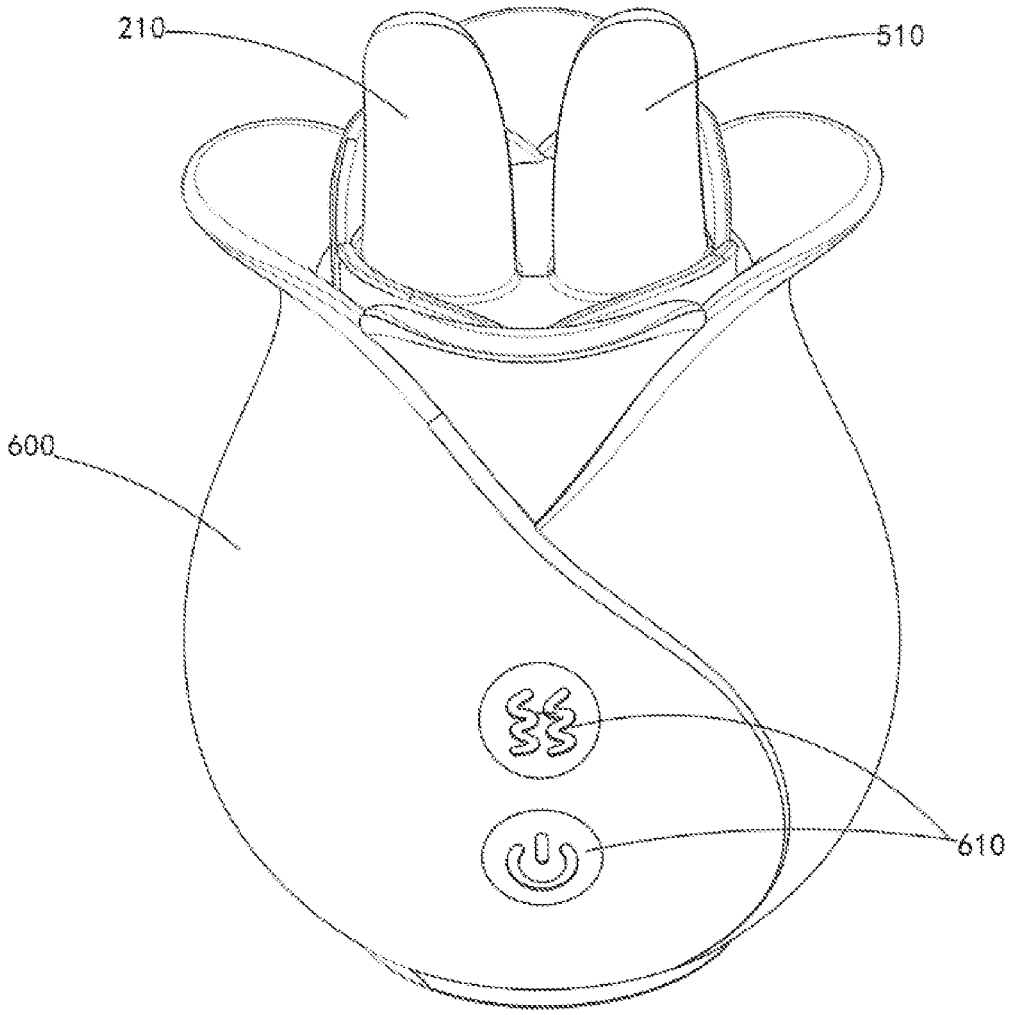
FIG. 9 is a schematic view of a double-headed cross-reciprocating-swinging massage apparatus according to an embodiment of the present disclosure.
Figure 10:
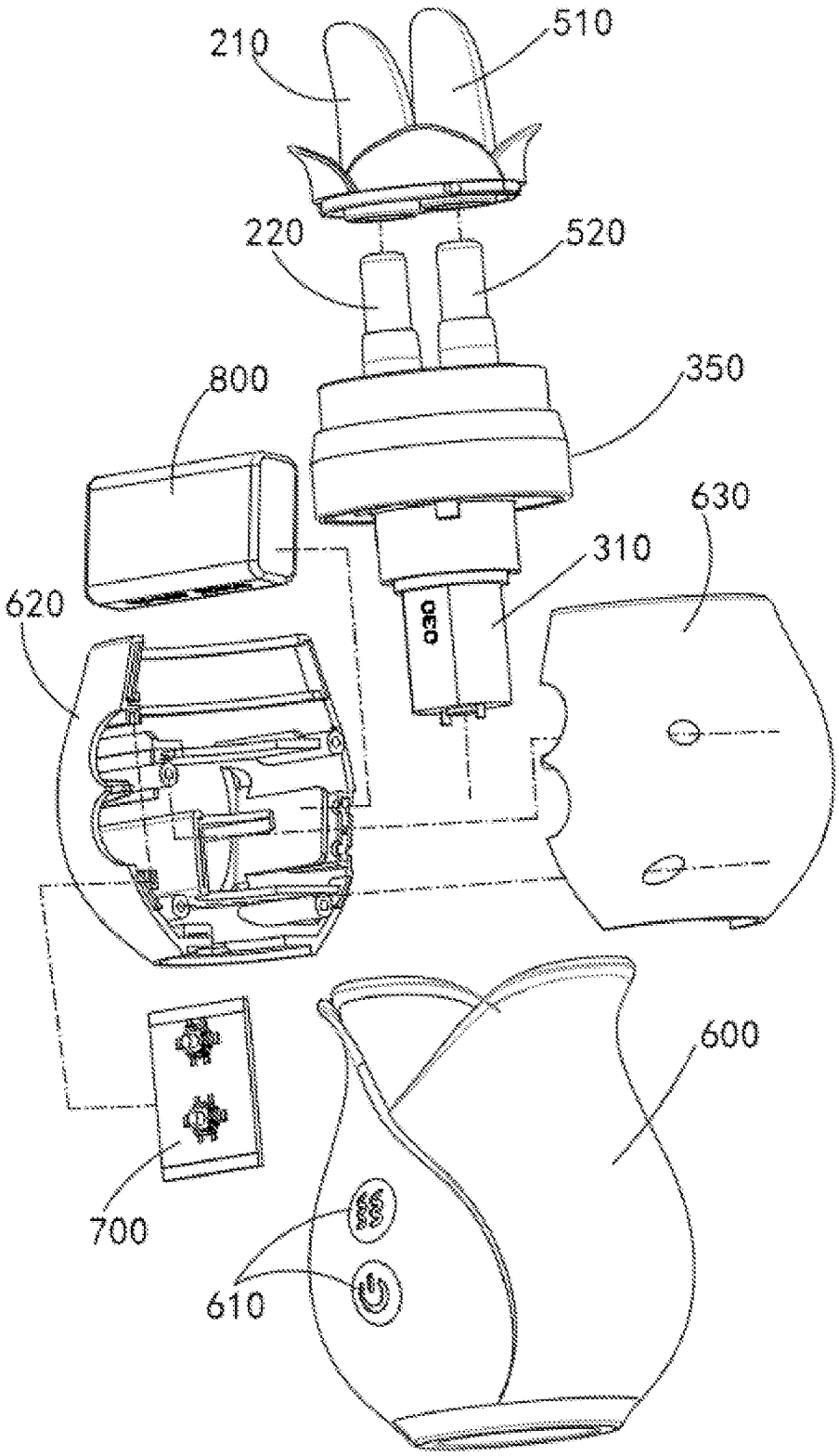
FIG. 10 is an exploded view of FIG. 9 according to the embodiment of the present disclosure.

Referring to FIG. 9 and FIG. 10, the massage apparatus is assembled together with an inner housing, an outer housing 600, a circuit board 700 and a rechargeable battery 800 to form a handheld massager. The inner housing includes a left shell 620 and a right shell 630, the left shell 620 defines a plurality of stud holes, and the right shell 630 defines a plurality of mounting holes corresponding to the stud holes. The circuit board 700 and the rechargeable battery 800 are mounted in a space enclosed by the left shell 620 and the right shell 630. The rechargeable battery 800 may be a lithium battery, adapted for supplying power to the handheld massager. The circuit board 700 controls the handheld massager to perform the massage action. The left shell 620 and the right shell 630 are engaged mutually to wrap the massage apparatus, and are fixed by screws which pass through the mounting holes and then are screwed in the stud holes. The outer housing 600 is substantially in a shape of a rose. The massage apparatus is inserted into the outer housing 600 through a hollow portion at a bottom of the outer housing 600 after being assembled with the left shell 620 and the right shell 630, and then a bottom cover is fixed to the bottom of the outer housing 600. A switch button 610 is arranged at an outside the outer housing 600, and a start button of the circuit board 700 is arranged corresponding to the switch button 610.

In this embodiment, as shown in FIG. 1 to FIG. 6, the massage driving mechanism 300 includes the rotary wheel 320, the driving portion 310, the first converting portion 340 and the second converting portion 330. A rotation axis of the rotary wheel 320 is configured to be perpendicular to the central axis of the pivoting shaft 100. The rotary wheel 320 includes a first cam joint and a second cam joint. The driving portion 310 is configured to drive the rotary wheel 320 to rotate, the rotation of the rotary wheel 320 is converted into the reciprocally swinging of the first massage head 500 about the central axis of the pivoting shaft 100 by means of cooperation of the first converting portion 340 and the first cam joint, and the rotation of the rotary wheel 320 is converted into the reciprocally swinging of the second massage head 200 about the central axis of the pivoting shaft 100 by means of cooperation of the second converting portion 330 and the second cam joint, thereby enabling the second massage head 200 and the first massage head 500 to perform the reciprocally swinging massage action in the manner of moving towards or away from each other.

As shown in FIG. 6, the rotary wheel 320 is driven to rotate by the driving portion 310, and then a rotary force of the rotary wheel 320 is transferred to the first converting portion 340 and the second converting portion 330 by the first cam joint and the second cam joint of the rotary wheel 320, respectively, such that the first converting portion 340 and the second converting portion 330 push and pull the first end of the first massage head 500 and the first end of the second massage head 200, respectively, so as to drive the first massage head 500 and the second massage head 200 to reciprocally swing about the central axis of the pivoting shaft 100 in the manner of moving towards or away from each other to generate a massage action.

Specifically, as shown in FIG. 1 to FIG. 6, the first cam joint includes a first boss wheel 321, the first boss wheel 321 is stacked on the rotary wheel 320 in an eccentric state relative to the rotation axis of the rotary wheel 320, and a first cam surface is formed on the outer circumferential surface of the first boss wheel 321.

The second cam joint includes a second boss wheel 322, the second boss wheel 322 is stacked on the first boss wheel 321 in an eccentric state relative to the rotation axis of the rotary wheel 320, and a second cam surface is formed on an outer circumferential surface of the second boss wheel 321.

The first converting portion 340 includes a first sliding portion 341 and a first conversion connecting portion 370. The first sliding portion 341 defines a first annular hole 342, and the first sliding portion 341 is movably inosculated with the first cam surface of the first boss wheel 321 through the first annular hole 342. The first conversion connecting portion 370 is connected between the first sliding portion 341 and the first end of the first massage head 500 to convert a movement of the first sliding portion 341 into a reciprocally swinging of the first massage head 500 about the central axis of the pivoting shaft 100.

The second converting portion 330 includes a second sliding portion 331, a second conversion connecting portion 360 and a guiding structure 350. The second sliding portion 331 defines a second annular hole 332, and the second sliding portion 331 is movably inosculated with the second cam surface of the second boss wheel 322 through the second annular hole 332. The second conversion connecting portion 360 is connected between the second sliding portion 331 and the first end of the second massage head 200 to convert a movement of the second sliding portion 331 into a reciprocally swinging of the second massage head 200 about the central axis of the pivoting shaft 100. During rotation of the rotary wheel 320, the first sliding portion 341 and a second sliding portion 331 are guided to move along a movement path perpendicular to the central axis of the pivoting shaft 100 respectively by the guiding structure 350, and moving directions of the first sliding portion 341 and the second sliding portion 331 at the same time are opposite.

As shown in FIG. 4 and FIG. 6, the first annular hole 342 and the second annular hole 332 both are substantially oval shaped or waist shaped. When the driving portion 310 drives the rotary wheel 320 to rotate, the first boss wheel 321 and the second boss wheel 322 on the rotary wheel 320 rotate along with the rotary wheel 320, the first cam surface of the first boss wheel 321 is in rolling contact with an inner wall of the first annular hole 342 of the first sliding portion 341, and the second cam surface of the second boss wheel 322 is in rolling contact with an inner wall of the second annular hole 332 of the second sliding portion 331, such that the rotary force of the first boss wheel 321 and the rotary force of the second boss wheel 322 are transferred to the first sliding portion 341 and the second sliding portion 331, respectively. Under the guiding of the guiding structure 350, the first sliding portion 341 and the second sliding portion 331 respectively move along the movement path perpendicular to the central axis of the pivoting shaft 100. Because the first boss wheel 321 and the second boss wheel 322 are stacked in a staggered manner, moving directions of the first sliding portion 341 and the second sliding portion 331 at the same time are opposite. Under an action of the first converting portion 340 and the second converting portion 330, movements of the first sliding portion 341 and the second sliding portion 331 are respectively converted into reciprocally swinging of the first massage head 500 and the second massage head 200 in the manner of moving towards or away from each other, such that the first massage head 500 and the second massage head 200 realize cross-reciprocally swing to reciprocally massage the body parts.

Figure 5:
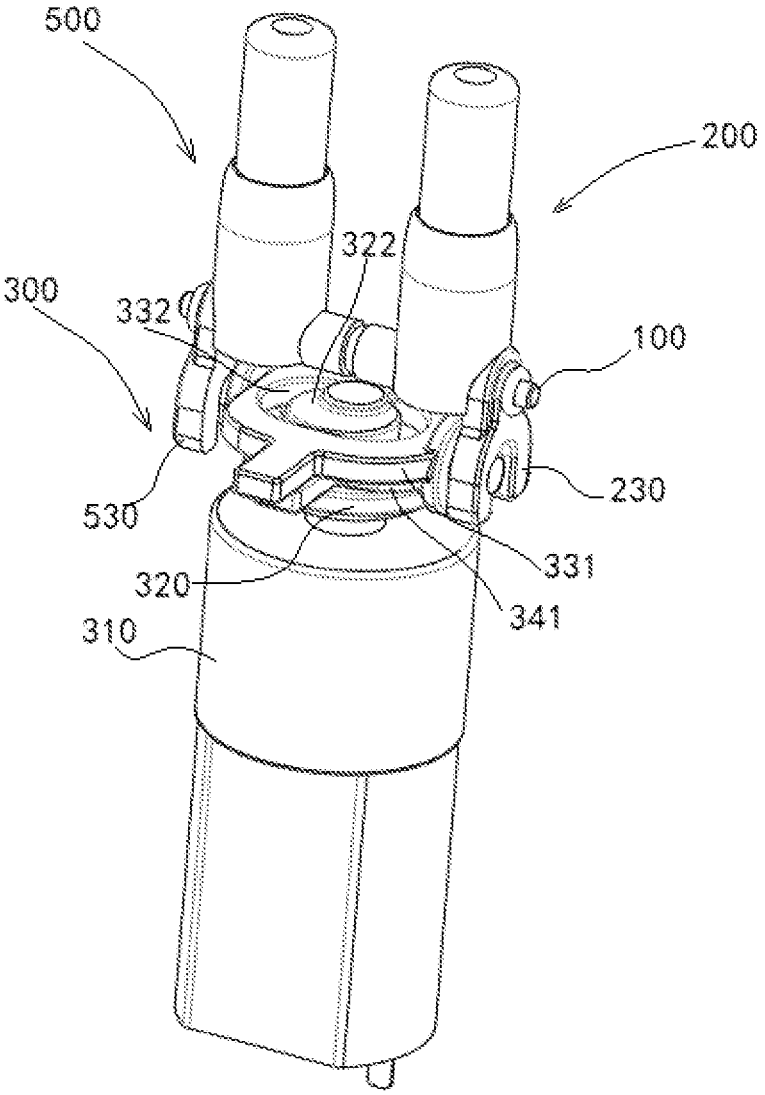
FIG. 5 is a perspective view of a first conversion connecting portion and a second conversion connecting portion according to an embodiment of the present disclosure.

As shown in FIG. 4 to FIG. 6, the first boss wheel 321 of the rotary wheel 320 in this embodiment serves as the first cam joint, and cooperates with the first annular hole 342 of the first sliding portion 341 through the first boss wheel 321, so as to obtain conversion of the rotation of the rotary wheel 320 together with the first boss wheel 321 into the movement of the first sliding portion 341. The second boss wheel 322 of the rotary wheel 320 serves as the second cam joint, and cooperates with the second annular hole 332 of the second sliding portion 331 through the second boss wheel 322, so as to obtain conversion of the rotation of the rotary wheel 320 together with the second boss wheel 322 into the movement of the second sliding portion 331. It should be understood that operation mechanisms constituted of the cooperated first cam joint of the wheel 320 and first sliding portion 341 or the cooperated second cam joint of the wheel 320 and second sliding portion 331 may be replaced by other similar operation mechanisms and be adjusted in structure, and any replacements and structural adjustments to the operation mechanism to achieve the same function without any creative efforts should be within the protection scope of the present disclosure.

In addition, as shown in FIG. 4 to FIG. 6, in this embodiment, two cams on the rotary wheel 320 respectively cooperate and link with the first sliding portion 341 and the second sliding portion 331 of a yoke type, realizing single driving portion 310 driving two massage heads to perform the reciprocally swinging massage action in the manner of moving towards or away from each other, i.e., realizing double-swinging under single drive, which results a simple and compact structure, a stable and reliable drive transferring manner, small in overall weight, convenient to use and assemble, and low in cost. Specifically, the driving portion 310 may be a rotary motor, and an output shaft 311 of the driving portion 310 is flat-shaped. A bottom of the rotary wheel 320 is provided with a prism-shaped mounting hole. The flat-shaped output shaft 311 of the driving portion 310 is mounted and cooperated with the prism-shaped mounting hole of the rotary wheel 320 to play a role of circumferential positioning, such that the rotary wheel 320 rotates more stable under the driving of the driving portion 310.

In an embodiment, as shown in FIG. 1 to FIG. 6, the first conversion connecting portion 370 includes a first shaft rod 344 and a first engaging slot 530, wherein the first shaft rod 344 is disposed at a left side of the first sliding portion 341, and the center axis of the first shaft rod 344 extends along a direction parallel to the center axis of the pivoting shaft 100; and the first engaging slot 530 is defined in the first end of the first massage head 500, the first engaging slot 530 extends downwards along the longitudinal axis of the first massage head 500, and the first engaging slot 530 is movably clamped on the first shaft rod 344.

The second conversion connecting portion 360 includes a second shaft rod 334 and a second engaging slot 230, wherein the second shaft rod 334 is disposed at a right side of the second sliding portion 331, and the central axis of the second shaft rod 334 extends in a direction parallel to the central axis of the pivoting shaft 100; and the second engaging slot 230 is defined in the first end of the second massage head 200, the second engaging slot 230 extends downwards along a longitudinal axis of the second massage head 200, and the second engaging slot 230 is movably clamped on the second shaft rod 334.

As shown in FIG. 4 to FIG. 6, when the driving portion 310 drives the rotary wheel 320 to rotate, the first boss wheel 321 and the second boss wheel 322 on the rotary wheel 320 cooperate with the first sliding portion 341 and the second sliding portion 331 respectively, such that the first sliding portion 341 and the second sliding portion 331 move along the movement path perpendicular to the central axis of the pivoting shaft 100 under the guiding of the guiding structure 350, wherein moving directions of the first sliding portion 341 and the second sliding portion 331 at the same time are opposite; and further the first shaft rod 344 at the left side of the first sliding portion 341 is cooperated with the first engaging slot 530 at the first end of the first massage head 500 to push and pull the first massage head 500 to reciprocally swing about the central axis of the pivoting shaft 100, and the second shaft rod 344 at the right side of the second sliding portion 331 is cooperated with the second engaging slot 230 at the first end of the second massage head 200 to push and pull the second massage head 200 to reciprocally swing about the central axis of the pivoting shaft 100, wherein swinging directions of the first massage head 500 and the second massage head 200 at the same time are opposite. During swinging of the first massage head 500 and the second massage head 200, the first shaft rod 344 and the second shaft rod 334 slide along the extending directions of the first engaging slot 530 and the second engaging slot 230 respectively, and meanwhile the first engaging slot 530 and the second engaging slot 230 rotate around the first shaft rod 344 and the second shaft rod 334 respectively. The first engaging slot 530 and the second engaging slot 230 are designed to provide a moving gap for sliding of the first shaft rod 344 and the second shaft rod 334. Accordingly, the massage apparatus is simple and compact in structure, stable and reliable in movement transferring manner, convenient and quick to assemble, and low in cost.

Specifically, as shown in FIG. 4 to FIG. 6, the first engaging slot 530 and the second engaging slot 230 are substantially in a shape of a fork plate. The first engaging slot 530 is located at the left side of the first end of the first massage head 500, the second engaging slot 230 is located at the right side of the first end of the second massage head 200, and plate surfaces of the first engaging slot 530 and the second engaging slot 230 are parallel to each other and perpendicular to the central axis of the pivoting shaft 100. In this way, a distance between the first engaging slot 530 and the second engaging slot 230 is larger. In a premise that the internal space of the massage apparatus is limit, sufficient moving space is reserved for reciprocally swinging of the first engaging slot 530 and the second engaging slot 230 under the driving of the first sliding portion 341 and the second sliding portion 331 respectively, so as to avoid fault due to interference contact during movement.

One end of the first shaft rod 344 close to the first sliding portion 341 has a first flange 345, and one end of the second shaft rod 334 close to the second sliding portion 331 has a second flange 335, and axially position to the first engaging slot 530 and the second engaging slot 230 are achieved through the first flange 345 and the second flange 335 respectively.

Figure 3:
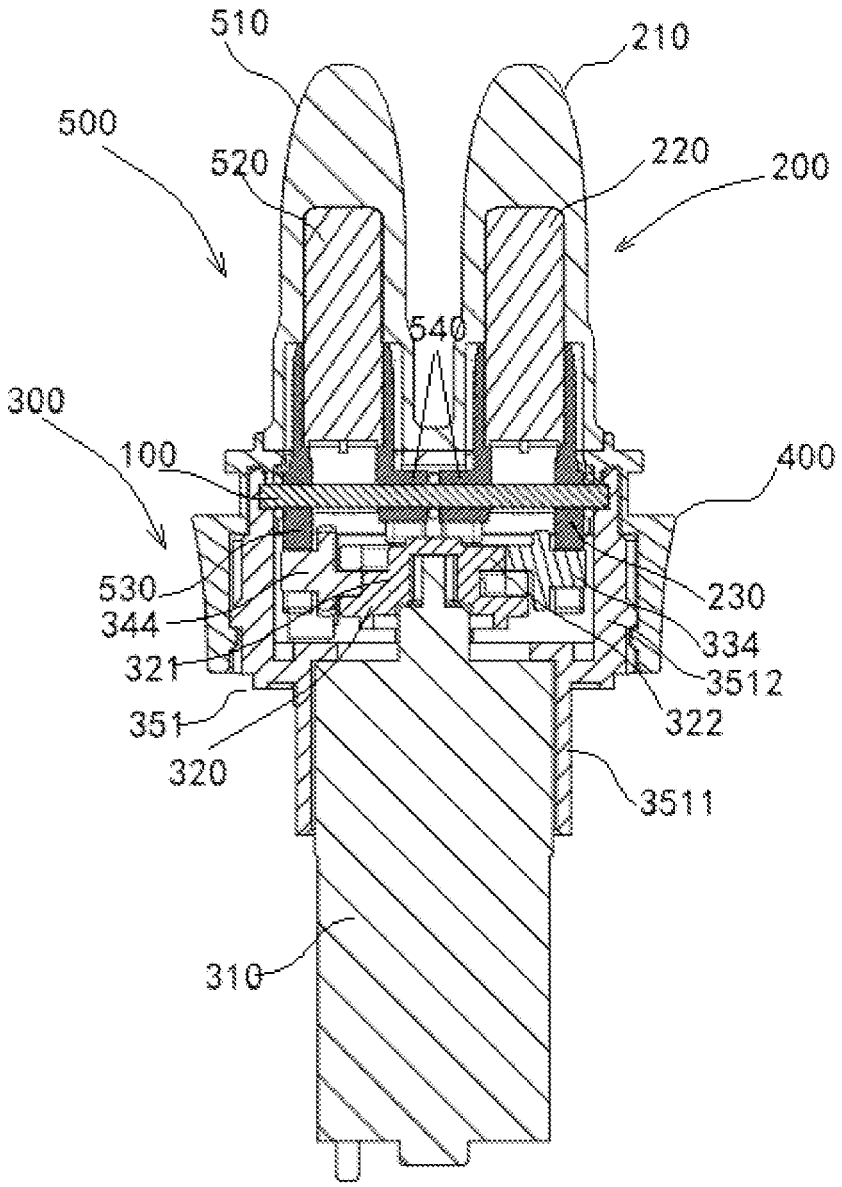
FIG. 3 is a cross-sectional view taken along line A-A of FIG. 2 according to an embodiment of the present disclosure.

In this embodiment, as shown in FIG. 3 to FIG. 4, the guiding structure 350 includes a fixed base 351, a first sliding block 343 and a second sliding block 333. A guiding slot 3513 is defined in the fixed base 351 and extends in a direction perpendicular to the central axis of the pivoting shaft 100. The first sliding block 343 is arranged at an end of the first sliding portion 341 and is slidably mounted within the guiding slot 3513, so as to guide the first sliding portion 341 to move along the movement path perpendicular to the central axis of the pivoting shaft 100 by means of sliding of the first sliding block 343 along the extending direction of the guiding slot 3513. The second sliding block 333 is arranged at an end portion of the second sliding portion 331 and is slidably mounted within the guiding slot 3513, so as to guide the second sliding portion 331 to move along the movement path perpendicular to the central axis of the pivoting shaft 100 by means of sliding of the second sliding block 333 along the extending direction of the guiding slot 3513.

Specifically, as shown in FIG. 3 to FIG. 4, the fixed base 351 is substantially in a shape of a cylindrical barrel, and an upper portion thereof is a large cylindrical sleeve 3512 and a lower portion thereof is a small cylindrical sleeve 3511. The small cylindrical sleeve 3511 is mounted around the upper end of the driving portion 310, and the large cylindrical sleeve 3512 is configured to accommodate and mount the pivoting shaft 100, the rotary wheel 320, the first converting portion 340 and the second converting portion 330. Some of the guiding slots 3513 are defined in the inner cylindrical walls of the front end and the rear end of the fixed base 351, so as to guide the first sliding block 343 and the second sliding block 333 to move along the movement path perpendicular to the central axis of the pivoting shaft 100. The guiding slot 3513 is a rectangular, and the first sliding block 343 and the second sliding block 333 both are strip-shaped plate. The first sliding portion 341 and the second sliding portion 331 are respectively mounted on the guiding slot 3513 of the fixed base 351 through the first sliding block 343 and the second sliding block 333 respectively, thereby providing supporting and guiding actions.

Figure 7:
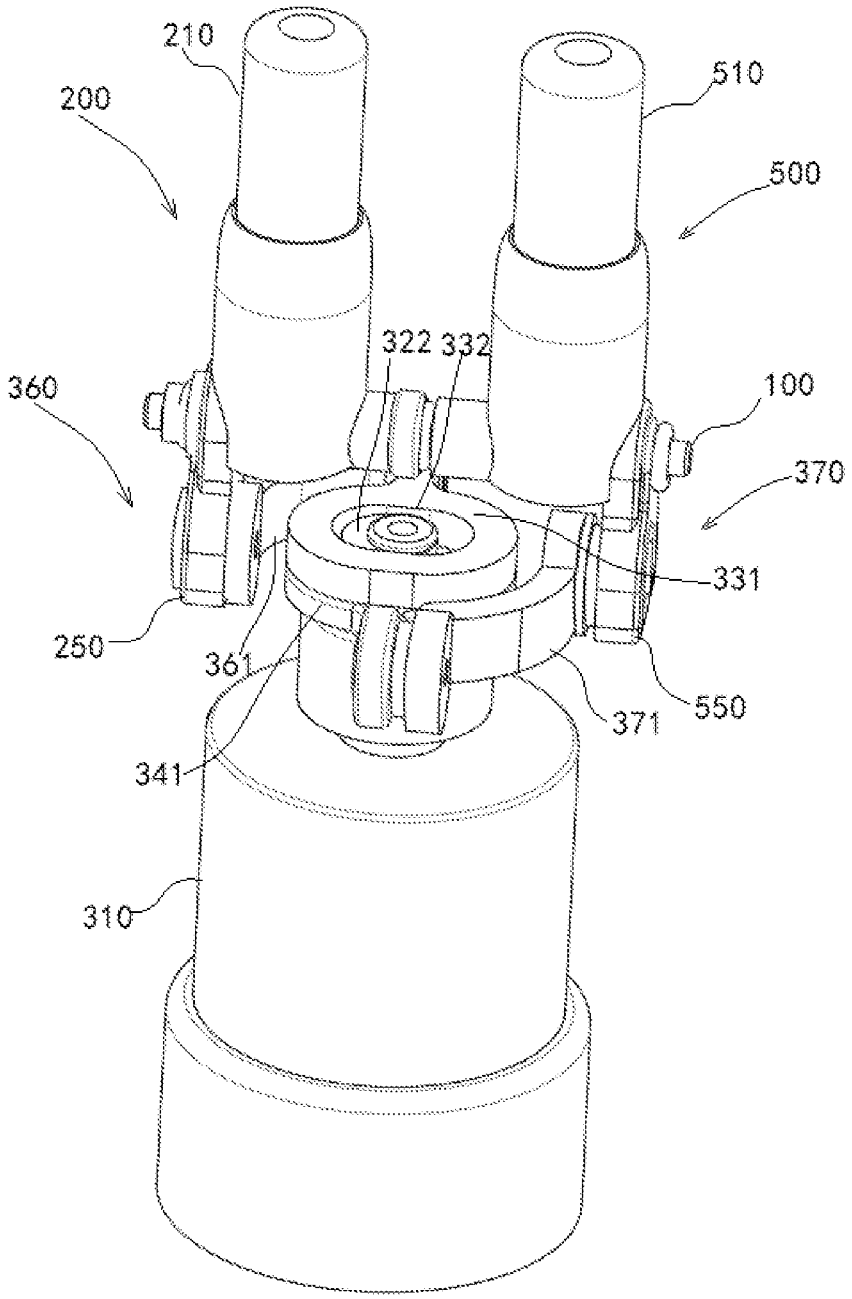
FIG. 7 is a perspective view of the first conversion connecting portion and the second conversion connecting portion according to another embodiment of the present disclosure.
Figure 8:
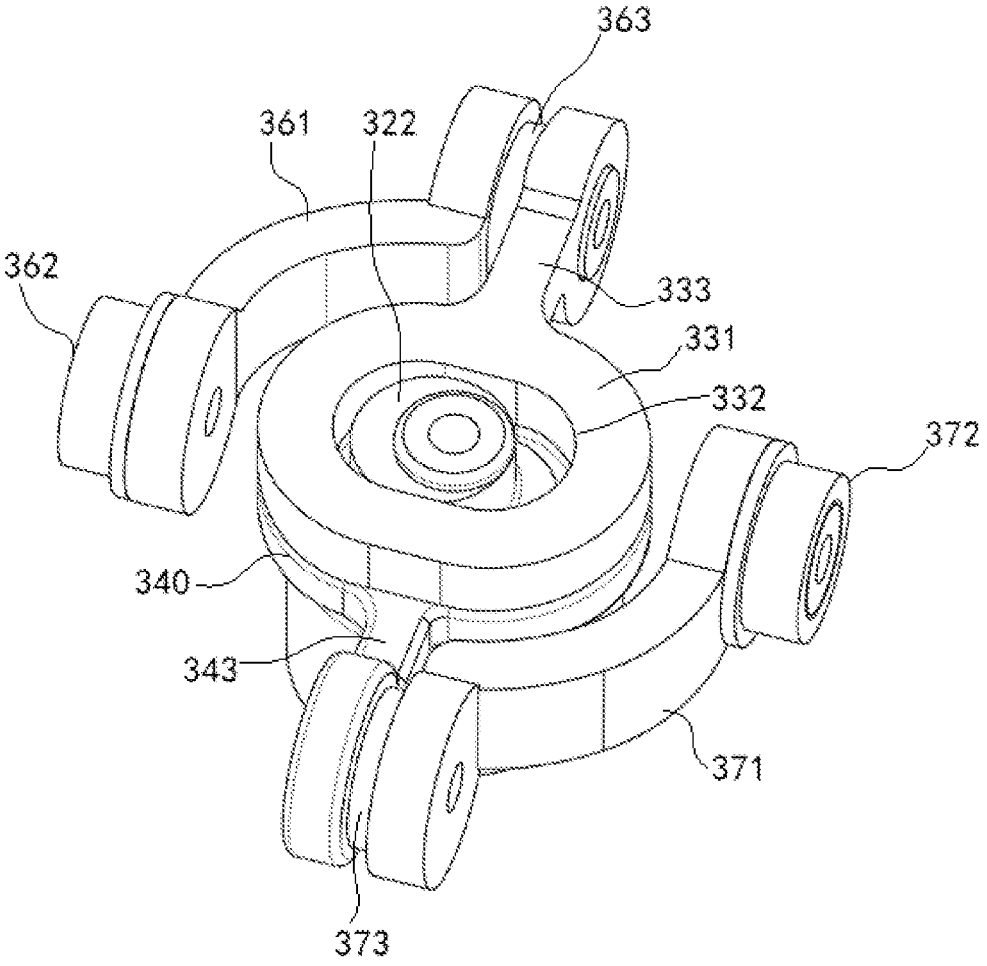
FIG. 8 is a schematic view of a part of FIG. 7 according to the embodiment of the present disclosure.

In an embodiment, as shown in FIG. 7 to FIG. 8, the first conversion connecting portion 370 includes a first swinging end 550 and a first link 371. The first swinging end 550 is disposed on the first end of the first massage head 500, and the first swinging end 550 extends downwards along the longitudinal axis of the first massage head 500; a first end of the first link 371 is pivotally connected with a tail end of the first sliding block 343 through the first articulating shaft 373, a second end of the first link 371 is pivotally connected with the first swinging end 550 through the second articulating shaft 372, and the central axis of the first articulating shaft 373 and the central axis of the second articulating shaft 372 are parallel to the central axis of the pivoting shaft 100.

As shown in FIG. 7 to FIG. 8, the second conversion connecting portion 360 includes a second swinging end 250 and a second link 361. The second swinging end 250 is disposed on the first end of the second massage head 200, and the second swinging end 250 extends downwards along the longitudinal axis of the second massage head 200; the first end of the second link 361 is pivotally connected with a tail end of the second sliding block 333 through a third articulating shaft 363, the second end of the second link 361 is pivotally connected with the second swinging end 250 through a fourth articulating shaft 362, and the central axis of the third articulating shaft 363 and the central axis of the fourth articulating shaft 362 are parallel to the central axis of the pivoting shaft 100.

As shown in FIG. 4, FIG. 7 and FIG. 8, when the driving portion 310 drives the rotary wheel 320 to rotate, the first boss wheel 321 and the second boss wheel 322 on the rotary wheel 320 are respectively cooperated with the first sliding portion 341 and the second sliding portion 331, such that the first sliding portion 341 and the second sliding portion 331 respectively move along the movement path perpendicular to the central axis of the pivoting shaft 100 under the guiding of the guiding structure 350, wherein moving directions of the first sliding portion 341 and the second sliding portion 331 at the same time are opposite; and further the first sliding block 343 of the first sliding portion 341 drives the first link 371 to push and pull the first swinging end 550 together with the first massage head 500 to reciprocally swing about the central axis of the pivoting shaft 100, and the second sliding block 333 of the second sliding portion 331 drives the second link 361 to push and pull the second swinging end 250 together with the second massage head 200 to reciprocally swing about the central axis of the shaft 100, wherein swinging directions of the first massage head 500 and the second massage head 200 at the same time are opposite. During swinging of the first massage head 500 and the second massage head 200, the first link 371 rotates relative to the first swinging end 550 to push and pull the first swinging end 550, and the second link 361 rotates relative to the second swinging end 250 to push and pull the second swinging end 250, thereby realizing the double-swinging under single drive, which results a simple and compact structure. The first conversion connecting portion 370 and the second conversion connecting portion 360 of the embodiment of FIG. 5 and FIG. 6 is relatively more simple and compact in compared with that of the embodiment of FIG. 7 and FIG. 8, and has more advantages.

Specifically, as shown in FIG. 7 to FIG. 8, the first link 371 extends curvedly around and is spaced from an outer circumferential surface of the first sliding portion 341, and the second link 361 extends curvedly around and is spaced from an outer circumferential surface of the second sliding portion 331. The first articulating shaft 373 and the third articulating shaft 363 are located at two ends of the first sliding portion 341, respectively. The first link 371 and the second link 361 are designed to be substantially of a centrally symmetric structure, such that there is enough moving space when the first link 371 and the second link 361 push and pull the first swinging end 550 and the second swinging end 250 respectively, so as to avoid the fault caused by interference contact during movement, and thus the drive transferring structure is more stable and reliable.

In this embodiment, as shown in FIG. 3 to FIG. 4, a left side and a right side of the fixed base 351 are provided with a supporting base 3514, respectively. Two ends of the pivoting shaft 100 are respectively placed on the two supporting bases 3514. The first massage head 500 and the second massage head 200 are pivotally connected to the pivoting shaft 100 at intervals along the central axis of the pivoting shaft 100. In addition, cylindrical barrels 540 protrude from the first massage head 500 and the second massage head 200 towards each other, and a spacer ring is arranged between the cylindrical barrel 540 of the first massage head 500 and the cylindrical barrel 540 of the second massage head 200 to pivotally connect the first massage head 500 and the second massage head 200 to the pivoting shaft 100, such that the second end of the first massage head 500 and the second end of the second massage head 200 are more stable and reliable when performing a reciprocally swinging about the pivoting shaft 100.

From the above description, it can be seen that the above-mentioned embodiments of the present disclosure achieve the following technical effects:

For the double-headed cross-reciprocating-swinging massage apparatus of the present disclosure, the second end of the first massage head 500 and the second end of the second massage head 200 are driven by the massage driving mechanism 300 to reciprocally swing about the central axis of the pivoting shaft 100 in the manner of moving towards or away from each other to generate the massage action. The first massage head 500 and the second massage head 200 reciprocally swing to massage body parts, thus to achieve two-way swinging massage, accelerate the swinging rate and increase the number of massages, thereby enhancing the massage effect, improving the massage experience, and meeting the user's strong requirement for the massage experience.

It should be understood that when an element is referred to as being "on" or "connected to" another element, it can be directly on the other element or directly connected to the other element or indirectly connected to the other element by an intervening element therebetween. On the contrary, when an element is referred to as being "directly on" or "directly connected to" another element, there are no intervening elements therebetween. Also, it should be noted that if directional indications (such as up, down, left, right, front, back, etc.) are involved in the embodiment of the present disclosure, the directional indications are only used to explain a relative position relationship, a movement condition and the like between various components under a certain posture (as shown in the accompanying drawings). If the specific posture changes, the directional indication changes accordingly.

The above are the preferred embodiments of the present disclosure. It should be noted that those skilled in the art can make several improvements and modifications without departing from the principles of the present disclosure, and these improvements and modifications may be regarded as the protection scope of the present disclosure.

What is claimed is:

1. A double-headed cross-reciprocating-swinging massage apparatus, comprising:

a pivoting shaft;

a first massage head comprising a first end being rotatably connected to the pivoting shaft;

a second massage head comprising a first end being rotatably connected to the pivoting shaft; and a massage driving mechanism being connected to the first end of the first massage head and the first end of the second massage head in a driving way respectively, making the massage driving mechanism be capable of driving the second end of the first massage head and the second end of the second massage head to reciprocally swing about a central axis of the pivoting shaft in a manner of moving towards or away from each other to generate a massage action; wherein the massage driving mechanism comprises: a rotary wheel comprising a first cam joint and a second cam joint, a rotation axis of the rotary wheel being perpendicular to the central axis of the pivoting shaft; a driving portion being configured for driving the rotary wheel to rotate; a first converting portion being configured for converting a rotation of the rotary wheel into the reciprocally swinging of the first massage head about the central axis of the pivoting shaft by cooperation of the first converting portion with the first cam joint; and a second converting portion being configured for converting the rotation of the rotary wheel into the reciprocally swinging of the second massage head about the central axis of the pivoting shaft by the cooperation of the second converting portion with the second cam joint, thereby making the second massage head and the first massage head perform the reciprocally swinging massage action in the manner of moving towards or away from each other.

2. The double-headed cross-reciprocating-swinging massage apparatus according to claim 1, wherein the second end of the first massage head is provided with a first flexible massage head, and the second end of the second massage head is provided with a second flexible massage head.

3. The double-headed cross-reciprocating-swinging massage apparatus according to claim 2, wherein a first vibration motor is arranged in the first flexible massage head, and a second vibration motor is arranged in the second flexible massage head.

4. The double-headed cross-reciprocating-swinging massage apparatus according to claim 1, wherein, the first cam joint comprises a first boss wheel stacked on the rotary wheel in an eccentric state relative to the rotation axis of the rotary wheel, and a first cam surface is formed on an outer circumferential surface of the first boss wheel;

the second cam joint comprises a second boss wheel stacked on the first boss wheel in an eccentric state relative to the rotation axis of the rotary wheel, and a second cam surface is formed on an outer circumferential surface of the second boss wheel;

the first converting portion comprises:

a first sliding portion defining a first annular hole, the first sliding portion being movably inosculated with the first cam surface of the first boss wheel through the first annular hole; and a first conversion connecting portion connected between the first sliding portion and the first end of the first massage head, for converting a movement of the first sliding portion into the reciprocally swinging of the first massage head about the central axis of the pivoting shaft; and the second converting portion comprises:

a second sliding portion defining a second annular hole, the second sliding portion being movably inosculated with the second cam surface of the second boss wheel through the second annular hole;

a second conversion connecting portion connected between the second sliding portion and the first end of the second massage head, for converting a movement of the second sliding portion into the reciprocally swinging of the second massage head about the central axis of the pivoting shaft; and a guiding structure being configured for guiding the first sliding portion and the second sliding portion to move along a movement path perpendicular to the central axis of the pivoting shaft respectively during rotation of the rotary wheel, moving directions of the first sliding portion and the second sliding portion at the same time being opposite, thereby making the second end of the first massage head and the second end of the second massage head reciprocally swing about the central axis of the pivoting shaft in the manner of moving towards or away from each other.

5. The double-headed cross-reciprocating-swinging massage apparatus according to claim 4, wherein, the first conversion connecting portion comprises:

a first shaft rod disposed at a left side of the first sliding portion, a central axis of the first shaft rod extending along a direction parallel to the central axis of the pivoting shaft; and a first engaging slot disposed at the first end of the first massage head, the first engaging slot extending downwards along a longitudinal axis of the first massage head, and the first engaging slot being movably clamped on the first shaft rod; and the second conversion connecting portion comprises:

a second shaft rod disposed at a right side of the second sliding portion, a central axis of the second shaft rod extending along a direction parallel to the central axis of the pivoting shaft; and a second engaging slot disposed at the first end of the second massage head, the second engaging slot extending downwards along a longitudinal axis of the second massage head, and the second engaging slot being movably clamped on the second shaft rod.

6. The double-headed cross-reciprocating-swinging massage apparatus according to claim 4, wherein the guiding structure comprises:

a fixed base defining a guiding slot, the guiding slot extending along a direction perpendicular to the central axis of the pivoting shaft;

a first sliding block disposed at an end portion of the first sliding portion, the first sliding block being slidably mounted within the guiding slot for guiding the first sliding portion to move along the movement path perpendicular to the central axis of the pivoting shaft by means of sliding of the first sliding block along the extending direction of the guiding slot; and a second sliding block disposed at an end portion of the second sliding portion, the second sliding block being slidably mounted within the guiding slot for guiding the second sliding portion to move along the movement path perpendicular to the central axis of the pivoting shaft by means of sliding of the second sliding block along the extending direction of the guiding slot.

7. The double-headed cross-reciprocating-swinging massage apparatus according to claim 6, wherein, the first conversion connecting portion comprises:

a first swinging end disposed at the first end of the first massage head, the first swinging end extending downwards along the longitudinal axis of the first massage head; and a first link with a first end thereof being pivotally connected with a tail end of the first sliding block through a first articulating shaft and a second end thereof being pivotally connected with the first swinging end through a second articulating shaft, a central axis of the first articulating shaft and a central axis of the second articulating shaft being parallel to the central axis of the pivoting shaft; and the second conversion connecting portion comprises:

a second swinging end disposed at the first end of the second massage head, the second swinging end extending downwards along the longitudinal axis of the second massage head; and a second link with a first end thereof being pivotally connected with a tail end of the second sliding block through a third articulating shaft and a second end thereof being pivotally connected with the second swinging end through a fourth articulating shaft, a central axis of the third articulating shaft and a central axis of the fourth articulating shaft being parallel to the central axis of the pivoting shaft.

8. The double-headed cross-reciprocating-swinging massage apparatus according to claim 7, wherein the first link extends curvedly around and is spaced from an outer circumferential surface of the first sliding portion, the second link extends curvedly around and is spaced from an outer circumferential surface of the second sliding portion, and the first articulating shaft and the third articulating shaft are located at two ends of the first sliding portion, respectively.

9. The double-headed cross-reciprocating-swinging massage apparatus according to claim 6, wherein a left side and a right side of the fixed base are provided with a supporting base, respectively, two ends of the pivoting shaft are respectively disposed on the two supporting bases, and the first end of the first massage head and the first end of the second massage head are pivotally connected to the pivoting shaft at intervals along the central axis of the pivoting shaft.

* * * * *